US006267698B1

(12) United States Patent
Orav

(10) Patent No.: US 6,267,698 B1
(45) Date of Patent: Jul. 31, 2001

(54) SOFT TIP GAME DART

(76) Inventor: Mihkel Orav, 12210 Bean Rd., Munson, OH (US) 44024-9098

( * ) Notice: Subject to any disclaimer, the term of this patent is extended or adjusted under 35 U.S.C. 154(b) by 0 days.

(21) Appl. No.: 09/497,910

(22) Filed: Feb. 4, 2000

(51) Int. Cl.[7] ..... A63B 65/02
(52) U.S. Cl. ..... 473/578
(58) Field of Search ..... 473/578, 582, 473/585, FOR 216, FOR 219, FOR 220

(56) References Cited

U.S. PATENT DOCUMENTS 3,454,276 * 7/1969 Brenkert et al. ..... 473/582 X
4,101,126 * 7/1978 Kurtz et al. ..... 473/582 X
4,951,952 * 8/1990 Saddler ..... 473/578 X
5,118,117 * 6/1992 Denen ..... 473/585

FOREIGN PATENT DOCUMENTS

1194661 * 11/1959 (FR) ..... 473/FOR 219
2026878 * 2/1980 (GB) ..... 473/FOR 219
21493 * 10/1993 (WO) ..... 473/FOR 219

* cited by examiner

*Primary Examiner*—John A. Ricci
(74) *Attorney, Agent, or Firm*—Howard D. Gordon

(57) ABSTRACT

A soft tip game dart (30) comprising a plastic tip portion (32), a metallic body portion (34), and a flight or tail portion (36). The tip portion is received in a bore (42) in the portion and is biased forwardly in the bore by a spring and plunger (64, 66). Cross-sectionally, non-annular peripheries of the bore and head section (56) of the tip cooperate to limit relative rotational movement therebetween.

15 Claims, 4 Drawing Sheets

SOFT TIP GAME DART

BACKGROUND OF THE INVENTION

1. Field of the Invention

The present invention relates to so-called "soft tip" or "safe" game darts. In particular, the present invention relates to a soft tip game dart having a tip portion which is easily replaced, which is not threadably attached to the dart body, which has an anti-bounce-back feature, and which, in at least a fully extended position, is rotationally fixed to the dart body, allowing the dart tip to be rotated relative to a dart board or target grid in which it is embedded for easier removal therefrom.

2. Description of the Prior Art

Game darts of the traditional metallic tip type wherein the tip portion is axially and/or rotationally movable relative to the dart body, usually to provide an anti-bounce-back feature, are known in the prior art, as may be seen by reference to U.S. Pat. Nos. 4,230,322; 4,596,393 and 5,419,567, the disclosures of which are incorporated herein by reference.

Recently, so-called "soft tip" or "safe" darts having relatively slender, rounded or blunt-ended plastic tips and utilized with a dart board having a target grid or array of closely spaced holes for retaining darts that strike the target grid, and a self-scoring mechanism, have become popular, as the potential for damage and/or injury is minimized and the need to have a person manually keeping score is eliminated. Examples of the general structure of soft tip darts and the self-scoring dart board machines utilizing same may be seen by reference to U.S. Pat. Nos. 4,457,514; 4,974,857 and 5,116,063, the disclosures of which are incorporated herein by reference.

A problem with the prior art devices is that the tip portions often fracture at the threaded connection, making removal of the remaining threaded portion from the dart body difficult and/or the tips would rotate with respect to the body, preventing removal of embedded darts from the target grid by rotationally "walking it out" and often leading to breakage of the tip and/or an anti-bounce-back feature was not provided.

SUMMARY OF THE INVENTION

In accordance with the present invention, an improved soft tip game dart is provided which minimizes or overcomes the drawbacks of the prior art. The foregoing is accomplished by providing a dart body having an elongated through bore having a relatively small opening at the front end of the body and an enlarged, threaded end at the rearward end for threadably receiving a flight portion and closing the bore. The soft tip portion includes a forwardly extending, generally cylindrically shaped shaft section having a relatively blunt tip for receipt and removable retention in the apertures of the target grid and a head section having a non-annular cross-section for slidable, generally close-fitting receipt in a portion of the bore having a periphery generally conforming to the non-annular cross-sectional shape of the tip portion head section, which will be received therein when the tip is furthest forwardly extending relative to the body. A spring, or preferably a spring-biased plunger, will seat on the flight portion and resiliently urge the tip point forwardly and outwardly and allow a resilient backward movement of the tip portion relative to the body for anti-bounce-back purposes.

In the forward position of the tip portion, the head section will cooperate with the forward portion of the bore to rotatationally fix the tip portion to the body portion, allowing the dart tip to be walked out of a grid aperture in a target.

Accordingly, it is an object of the present invention to provide a new and improved soft tip game dart.

This and other objects and advantages of the present invention will become apparent from a reading of the following description of the preferred embodiment taken in connection with the attached drawings.

DESCRIPTION OF THE PREFERRED EMBODIMENT

Figure 1:
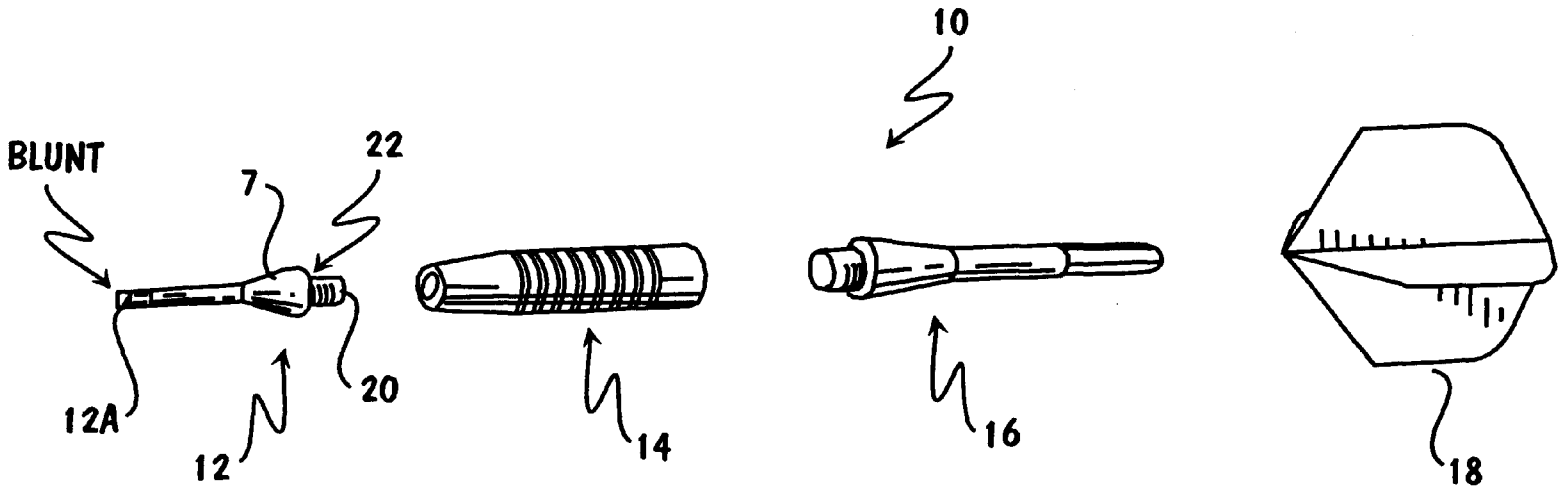
FIG. 1 (Prior Art)
FIG. 1 is an exploded view of a typical prior art soft tip dart (FIG. 1 of U.S. Pat. No. 4,457,514 shown with blunt tip).
Figure 1A:
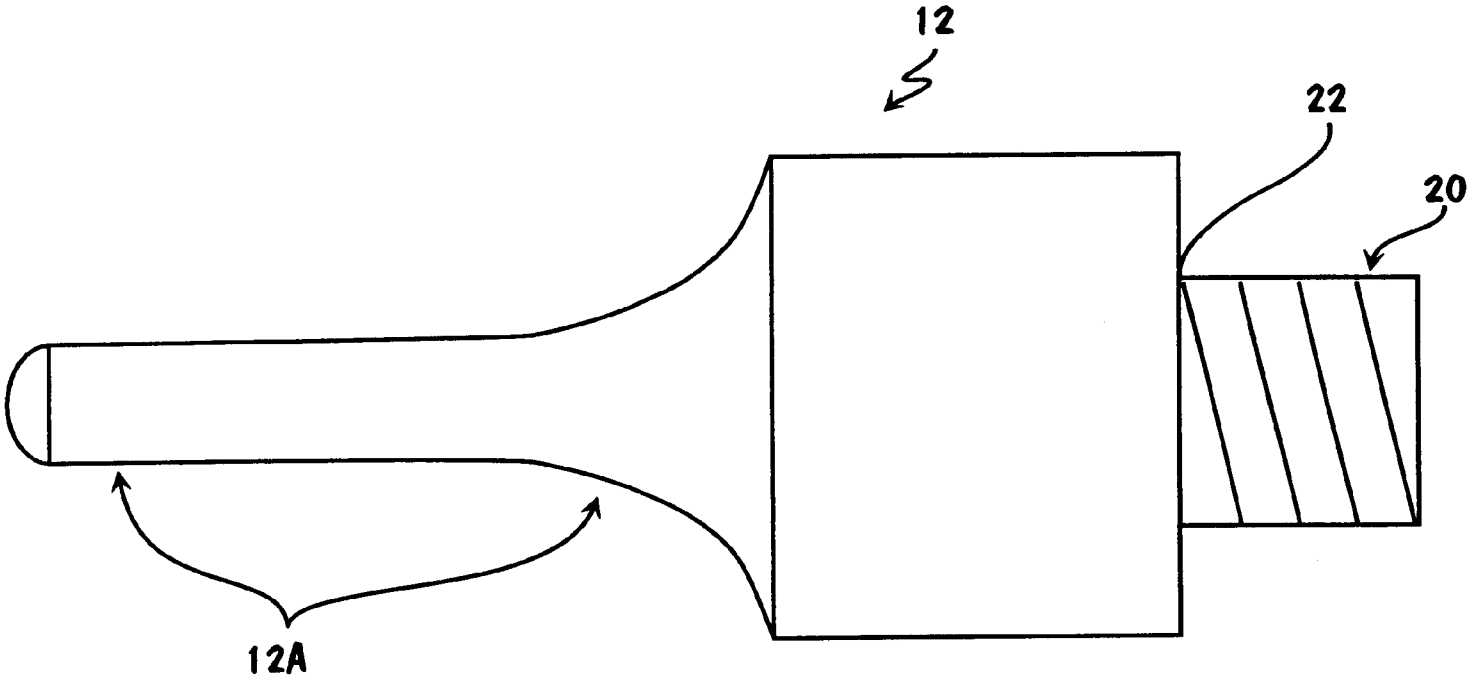
FIG. 1A (Prior Art)
FIG. 1A is an enlarged view of the tip portion of the prior art dart of FIG. 1.
Figure 2:
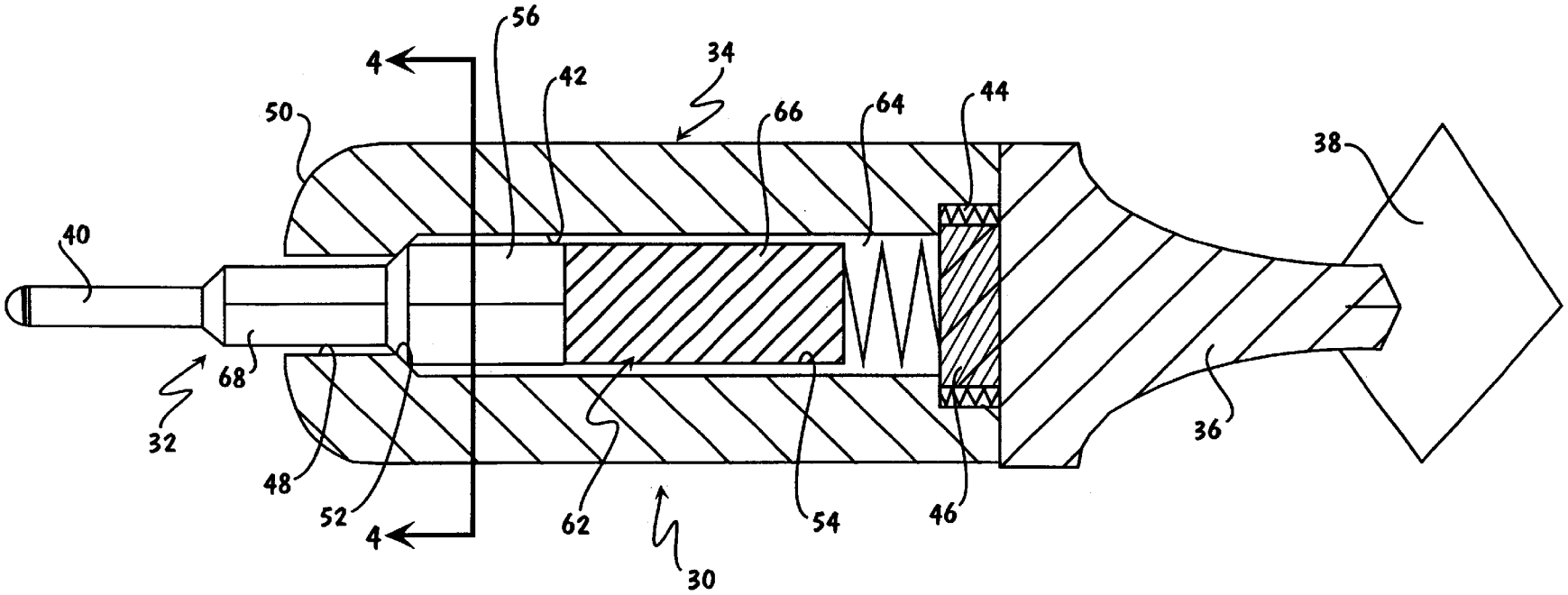
FIG. 2 is a sectional view of the soft tip game dart of the present invention.

A typical prior art soft tip game dart 10 may be seen by reference to FIGS. 1 and 1A. The dart 10 includes a plastic tip portion 12, a body portion 14, and a flight portion 16 for receiving flights 18. The tip portion 12 includes a rounded or blunt-tipped shaft section 12A.

As may be seen, the tip portion 12 is threadably attached to the body portion by a threaded shaft 20. A problem with these prior art game darts is that the tip portions tend to crack at junction 22 of the threaded shaft and the tip portion. Arrow 23 points to other areas of the tip 12 portion at which fractures typically occurred. The dart 10 also has no anti-bounce-back structure.

The soft tip game dart 30 of the present invention may be seen in cross-section in FIGS. 2–5B. Game dart 30 includes a soft tip portion 32, a body portion 34, and a flight or tail portion 36 for receiving flights 38. Tip portion 32 includes a rounded or blunt shaft section or tip 40 for embedding in the target grid apertures of a target.

Body portion 34 includes a through bore 42 having an enlarged, interiorally threaded, rearward opening 44 for threadably receiving the interiorally threaded section 46 of the flight portion 36. Flight portion 36 may be functionally and structurally identical or substantially identical to the prior art flight portion 16 illustrated in FIG. 1.

Bore 42 includes a relatively smaller cross-section forward opening 48, which will define a shoulder 50 to engage a shoulder 52 on the tip portion to limit the forward movement of the tip portion 32 relative to the body portion 34. Bore 42 includes an intermediate section 54 for slidably receiving a head or piston section 56 of the tip portion 32.

Figure 3:
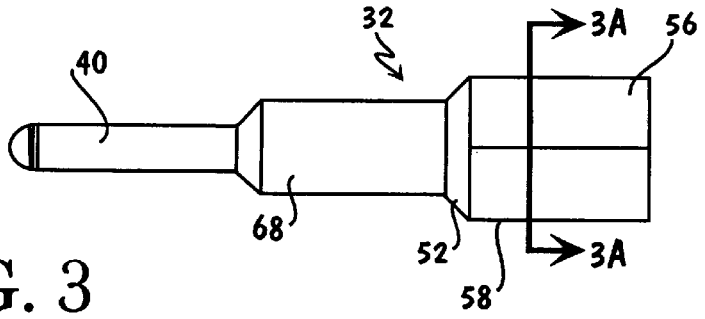
FIG. 3 is an enlarged view of the point section of the soft tip game dart of the present invention.
Figure 3A:
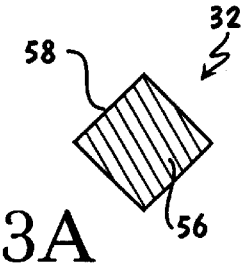
FIG. 3A is a sectional view taken at line 3—3 of FIG. 3.
Figure 4:
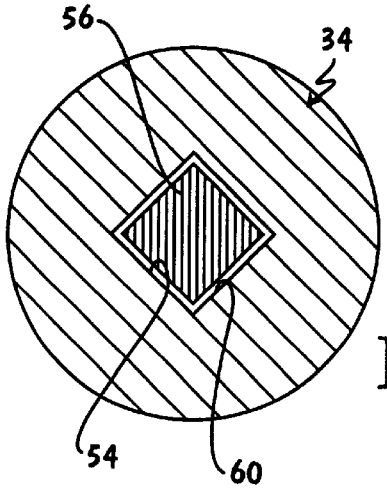
FIG. 4 is a sectional view taken at line 4—4 of FIG. 2.

As may better be seen by reference to FIGS. 3–3A and 4, the exterior periphery 58 of head section 56 and the interior 60 of intermediate bore section 54 define relatively closely fitting, non-annular surfaces (shown as cross-sectionally square for example only), which at least when the tip section 32 is fully forward relative to the body section 34, will allow relative axial movement but limit relative rotational movements therebetween.

Figure 5A:
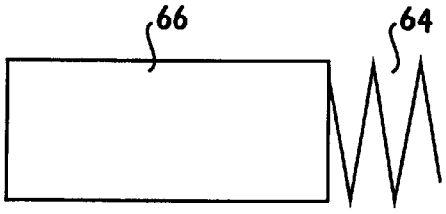
FIGS. 5A and 5B are alternate embodiments or arrangements of the spring and plunger assembly of the soft tip game dart of FIG. 2.
Figure 5B:
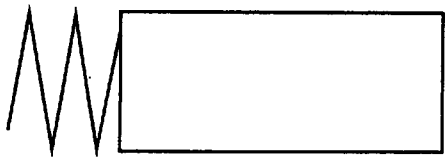

A spring-biased piston assembly 62 biases the point section forwardly (i.e., urges shoulder 52 into contact with shoulder 50), while allowing resilient rearward movement of the point section relative to the body section to provide an anti-bounce-back feature. FIGS. 5A and 5B illustrate alternate arrangements for the spring 64 and piston or plunger 66. Plunger 66 is preferably metallic to provide proper adjustable weighting and balance of the game dart.

For added stability, the point portion 32 will preferably include an intermediate section 68 having a cross-sectional shape closely matching the shape of opening 48.

As may be seen, the soft tip game dart 30 of the present invention eliminates a threaded shaft connection on the plastic tip 32, provides an antibounce-back feature, allows easy replacement of damaged or worn tips, and limits rotational movement between the tip and body portions, allowing relatively easy removal of the dart by a twisting motion from a target in which it has embedded.

The preferred embodiment of the the present invention has been described by way of example and certain modifications and rearrangements of the parts are possible without departing from the spirit and scope of the invention as hereinafter claimed.

I claim:

1. A soft tip game dart comprising a plastic tip portion, a metallic body portion, and a flight portion;

said body portion defining a through bore having a reduced dimension forward opening and a section having a cross-sectionally, non-annular interior periphery;

said tip portion including a rounded or blunt-ended shaft section extending forwardly from an enlarged head section, said head section slidably received in said bore and having an outer periphery generally conforming to said cross-sectionally, non-annular interior periphery of said bore to limit relative rotational movement between said point and body;

and means biasing said point portion forwardly in said bore.

2. The game dart of claim 1 wherein said bore is threaded at its rearward end for threadably engaging a threaded section of said flight portion.

3. The game dart of claim 2 wherein said biasing means comprise a spring-and-plunger assembly received in said bore.

4. The game dart of claim 3 wherein said non-annular outer periphery of said head section is received in said non-annular periphery of said bore at least when said tip portion is in its most forward axial position relative to said bore.

5. The game dart of claim 3 wherein said cross-sectionally, non-annular periphery is a polygonal periphery.

6. The game dart of claim 3 wherein said tip portion includes an intermediate section intermediate said shaft and head sections.

7. The game dart of claim 3 wherein said tip portion is rearwardly, axially movable against the forward bias of said biasing means.

8. The game dart of claim 3 wherein said plunger is metallic.

9. The game dart of claim 2 wherein said non-annular outer periphery of said head section is received in said non-annular periphery of said bore at least when said tip portion is in its most forward axial position relative to said bore.

10. The game dart of claim 9 wherein said cross-sectionally, non-annular periphery is a polygonal periphery.

11. The game dart of claim 9 wherein said tip portion is rearwardly, axially movable against the forward bias of said biasing means.

12. The game dart of claim 2 wherein said cross-sectionally, non-annular periphery is a polygonal periphery.

13. The game dart of claim 12 wherein said tip portion is rearwardly, axially movable against the forward bias of said biasing means.

14. The game dart of claim 2 wherein said tip portion is rearwardly, axially movable against the forward bias of said biasing means.

15. The game dart of claim 1 wherein said tip portion is rearwardly, axially movable against the forward bias of said biasing means.

* * * * *